US009993081B1

(12) United States Patent
McLellen

(10) Patent No.: US 9,993,081 B1
(45) Date of Patent: Jun. 12, 2018

(54) UNIVERSAL POWERED ROCKING SYSTEM

(71) Applicant: Arthur Oscar McLellen, Woodstock, GA (US)

(72) Inventor: Arthur Oscar McLellen, Woodstock, GA (US)

( * ) Notice: Subject to any disclaimer, the term of this patent is extended or adjusted under 35 U.S.C. 154(b) by 169 days.

(21) Appl. No.: 15/214,357

(22) Filed: Jul. 19, 2016

Related U.S. Application Data

(60) Provisional application No. 62/329,139, filed on Apr. 28, 2016.

(51) Int. Cl.
*A47C 3/02* (2006.01)
*A47C 7/00* (2006.01)

(52) U.S. Cl.
CPC ..... *A47C 3/02* (2013.01); *A47C 7/002* (2013.01)

(58) Field of Classification Search
USPC ..... 297/133
See application file for complete search history.

(56) References Cited

U.S. PATENT DOCUMENTS 3,019,052 A 1/1962 Zawadzki et al.
3,758,156 A 9/1973 Zawadzki et al.
3,818,517 A 6/1974 Casella
4,544,201 A * 10/1985 Rogers, Jr. ..... A47C 1/0355 297/259.2
4,775,184 A 10/1988 Larkin
4,911,499 A 3/1990 Meeker
5,368,361 A 11/1994 Wen-Ming
5,427,433 A * 6/1995 Holobaugh, Jr. .... A47C 3/0255 248/370
5,742,960 A * 4/1998 Shamir ..... A47D 9/04 248/143
5,860,698 A 1/1999 Asenstorfer et al.
6,152,529 A 11/2000 Beason
6,406,095 B1 * 6/2002 Bouchard ..... A47C 3/0255 297/270.1
6,412,867 B2 7/2002 Robinson
7,377,587 B1 * 5/2008 Guillot ..... A47C 3/0255 16/385
7,537,285 B2 5/2009 Stewart
2010/0052387 A1 * 3/2010 Hopke ..... A47D 9/02 297/260.2
2011/0248535 A1 10/2011 LaPointe
(Continued)

FOREIGN PATENT DOCUMENTS

GB 574307 A * 12/1945 ..... A47C 3/0255

*Primary Examiner* — David E Allred
(74) *Attorney, Agent, or Firm* — Bradley D. Crose; Crose Law LLC

(57) ABSTRACT

A universal powered rocking system is disclosed with the ability to change between different styles and size chairs and different rocking motion styles in a single embodiment and with a unique mounting method to easily interchanging the universal powered rocking system with different chairs by a single user or permanently replace the feet or foundation of a chair. A universal powered rocking system with the ability to rock the chair while allowing the chair to use its original functions such as a pawl ratchet latching system and stationary style chair which have no means of manually rocking. A universal powered rocking system that the chair is constantly balanced on the rocking apparatus for operations and eliminates the jerky motion inherent to the linear motion.

8 Claims, 4 Drawing Sheets

(56) References Cited

U.S. PATENT DOCUMENTS

| | | | | |
|---|---|---|---|---|
| 2012/0022412 | A1 | 1/2012 | Bryant | |
| 2012/0025573 | A1* | 2/2012 | Lin | A47C 3/0255 297/258.1 |
| 2014/0191548 | A1 | 7/2014 | McLellen | |
| 2015/0145301 | A1* | 5/2015 | Jacques | A47C 3/025 297/260.2 |
| 2017/0099949 | A1* | 4/2017 | Fortier | A47C 3/02 |

* cited by examiner

UNIVERSAL POWERED ROCKING SYSTEM

CROSS-REFERENCE TO RELATED APPLICATION(S)

The present non-provisional patent application claims the benefit of priority of U.S. Provisional Patent Application No. 62/329,139, which is entitled "Universal Powered Rocking System", which was filed on Apr. 28, 2016, and which is incorporated in full by reference herein.

FIELD OF THE INVENTION

The technology described herein relates generally to an apparatus, system, and associated methods for creating a powered rocking chair and the like. More specifically, this technology relates to a powered rocking apparatus which has an improved method of mounting for diverse size and width chairs without attachment hardware with means to power rock a stationary chair without the ability to manually rock and means to rock a chair in multiple motion styles while still allowing the chair to use its original functions incorporated in a single embodiment.

BACKGROUND OF INVENTION

This section provides background information related to present disclosure and may not necessarily be in prior art.

People enjoy relaxing in the comfort of a chair that rocks and glides in a reciprocatory motion. The motion may have a soothing effect and lend to put the occupant of the chair to sleep. However, the chair needs propelling in some manner. The propulsion is usually accomplished by the occupant of the chair pushing on the floor with their legs and feet, while sitting thereon. After a period of time, the occupant of the chair usually stops pushing due to exhaustion and falling asleep. To continue the reciprocatory motion, the occupant of the chair may have to resume with their feet, which prevents the occupant of the chair from sleeping in the chair.

There has been a long recognized need to allow an individual to rock in a reclined position with their legs and feet elevated on the leg rest and ottoman. This position also allows the occupant of the chair to sleep more comfortably in the chair. This more comfortable popular position will not allow the feet of the occupant of the chair to come in contact with the floor surface for propulsion.

Additionally, the prior art of a reclining rocking chairs with a leg rest has two frames. One of the frames is the base of the chair with the feet and the other is the frame of the seat of the chair that rocks on top of the frame of the base with the feet of the chair. This prior art has a pawl and ratchet latching mechanism that latches when the leg rest is extended to hold the position of the frame of the seat of the chair to the frame of the base of the chair to prevent the chair from tilting too far forward, while over balanced. This latching also prevents the chair from any rocking motion and restricts the occupant of the chair from manually and powered rocking the chair. prior art such as US 20140191548 A1 has a pawl and ratchet latching controller to allow the chair to rock but is more costly.

Heretofore, such prior art has suffered from several deficiencies. Specifically, prior art does not address the problem of balancing the rocking chair when the occupant sits on it before the motor drive engages to create the rocking motion. Also the motion cycle should be balanced with the balance of the chair to equal a balanced system. When using a powered rocker system with a rotary and linear motion drive, the chair should be balance in the middle of the motion cycle before beginning the rocking motion. The middle of the motion cycle is the middle between the maximum and minimum length of the stroke for linear motion and the middle of the maximum and minimum height of the motor arm of the rotary cycle. The engaging position for the motor drive will vary depending on the weight of the occupant of the chair and how far backward and forward the occupant of the chair leans when sitting.

Some prior art have a locking system for the motor drive linkage that uses a solenoid, has continual electrical powered to keep the motor drive locked while the motorized rocking mechanism is in use. This continual electrical powered use may cause a heat buildup and some safety problems. Some of these mechanisms of the prior art have been provided, as disclosed in US Patent No. 2011/0248535 A1.

Another deficiency is that prior art is not diverse for different size and width chair in a single embodiment. The prior art is difficult to mount and has to be modified to fit different size chairs and permanently attached to the chair for balance. This attaching make it difficult to transfer the device from one chair to another and mostly will not fit due to a different size chairs and different frame structures. The chair is awkward to work on and lifting the chair is impossible single handed. They are hard to install and most have to be installed using tools and attachment hardware.

Some prior art uses a rotation motion cycle to power a linear motion cycle for the motor drive movement to create the rocking motion of the chair. One of the most comforting motions for the occupant of the chair is a constant, uninterrupted and smooth rocking and reciprocatory motion which this linear motion will not produce. The reciprocatory linear movement travels to and from a single start point on the motion cycle in a straight line. The motion has two reverse motion points in the cycle, with an abrupt transition in change of direction. This causes a jerking and interruption motion in the cycle as the means to rock the chair. Some of these chairs use springs to attempt to absorb and eliminate the shock in the sudden start and stop of the linear motion. But the springs actually create the same jerking and interruptive motion problem they are attempting to resolve, by compressing and expanding in the motion cycle. Some of these mechanisms of the prior art having the springs and linear motion have been provided, as disclosed in US Patent No. 2011/0248535 and U.S. Pat. No. 6,152,529.

Some prior art uses a striking and release contact means of rocking, which strikes a fixed object and then releases to let gravity finish the motion cycle. This also has an interruptive motion and causes jerking in the motion cycle. Some of these mechanisms of the prior art having a striking contact and release method have been provided, as disclosed in U.S. Pat. No. 7,537,285 B2, U.S. Pat. No. 3,886,608 and U.S. Pat. No. 4,775,184. All of these methods have a jerking and interrupting motion for the rocking cycle, which is uncomfortable to the occupant of the chair.

The glider rocker may use a gliding ottoman to rest the legs and feet of the occupant of the chair and also does not allow the feet of the occupant of the chair to come in contact with the floor surface for propulsion. The occupant of the chair can not manually rock the chair in this relaxed position.

The prior art uses a single rocking motion style. This style is determined by the method of the manufacture of the prior art. Prior art does not offer more than one rocking motion style in a single embodiment.

The inventive art resolves the outlined deficiencies in the prior art. Other objects, features, advantages and benefits of the present invention will become apparent upon reading the following specification, when taken in conjunction with the accompanying drawings.

SUMMARY OF THE INVENTIVE ART

The inventive art is an improved design from the prior art of powered rocking systems and can be applied to a greater variety of chairs without being permanently secured with attachment hardware which allows the freedom to easily move the inventive art to other chairs of different size and widths and continue using the same original functions of the chair.

The inventive art is versatile and dynamic which gives the occupant the ability to change the rocking motion style such as swinging motion, rocking motion, an up and down motion and a gliding motion, incorporated in a single embodiment.

The inventive art has a simpler design than prior art which eliminating a pawl and latching mechanism controller. The design eliminates the need for other controllers also which cuts costs and processes. The inventive art is a solution to rocking the stationary style chair that has no means of manually rocking by lifting the complete chair off its foundation to freely move and be controlled. Prior art uses springs to keep the chair balanced when not in use and prevent over balancing when rocking which interferes when being powered rocked. The inventive art overrides the necessity of the rocking chair feet springs. The invention is intended to rock the complete chair without any interference from the normal operation of the chair unlike prior art and may be used to permanently replace the base or feet of the chair.

The inventive art eliminated the load on the motor mechanism and motor connector arm when the motor is not in use by returning the motor connector arm back to the original start stop position when turned off which keeps all of the load on the rocker foot, rocker arms and rocker base.

The inventive art eliminates the complicated methods of the prior art by using a simpler means to control the complete chair. The actions of the invention is one mechanical function that overrides all other operational functions of the chair.

An advantage of the inventive art over prior art is its versatility.

Inventive art has the ability to power rock both a stationary style chair as well as chairs that can be manually rocked. The inventive art can be easily transferred from one chair to another without permanently attaching them together for balance. Inventive art overrides the pawl and ratchet latching mechanism which is incorporated in the frame of some chairs and allows all the original functions of the chair to operate.

The inventive art has an improved mounting method over prior art. This method uses a dual rocking apparatus of which is two identical and independent rocking apparatus which allow a single person an easier way to mount a chair by rolling the chair onto the dual rocking apparatus to control and balance and allow the rocking apparatus to rock the stationary style recliners as well as the rocking recliners without connecting hardware. The inventive art is universal in that the mounting means of a dual rocking apparatus allows the inventive art to adapt and accommodate chairs with difference sizes and widths in a single embodiment. The mounting means also overcomes the locking problem of the pawl and latching mechanism by allowing the user to continue using this operation for locking the leg rest while being able to rock the chair. The pawl and ratchet latching mechanism is the proprietary property of the manufacturer of the reclining rocking chair and is located on the frame of the base of the chair and the ratchet hardware is located on the frame of the seat of the chair. The ratchet hardware is located on the frame of the rocking chair closest to the leg rest and the pawl latches to the ratchet hardware when the leg rest is raised to prevent the chair from tilting forward over balanced.

The inventive art solves the problem of a single rocking motion style of the prior art by allowing different motion styles in a single embodiment. The multiple rocking motion styles are accomplished with the use of the bearing arms positioning with the motion style connector slot(s) to change the angle of the bearing arm to multiple rocking styles in a single embodiment which is not available in prior art.

The inventive art can operate on stationary objects and the like such as cribs, bassinets and chairs with no rocking mechanism. A large variety of objects can be rocked using the inventive art.

There is usually a jerking motion when an object is powered in a reciprocatory linear motion due to the sudden change of direction of the motor connector arm. The inventive art solves this jerking motion that is inherent by changing the rocking motion style from a straight line linear motion to a rocking motion style that has a softer rounded reversal motion style.

The universal powered rocking system comprises: a dual rocking apparatus with means to rock a chair; a said dual rocking apparatus with means to replace the functions of balance and support of the base or feet of a chair; means of securing a chair to said dual rocking apparatuses to balance both and to allow the said dual rocking apparatus to work unison to control the said chair without using attaching hardware and accommodate various width and size chairs in a single embodiment; method for mounting the said dual rocking apparatus which is balanced and secure for ease, quickness and convenience of transfer from one chair to another chair; means to provide diversified rocking motion styles in a single embodiment which also eliminating the jerky movement of the linear motion; means of eliminating the downward load bearing weight off the motor mechanism and motor connector arm for longer life; and means of eliminating the lateral load bearing weight off the motor mechanism and motor connector arm for longer life.

Said means of dual rocking apparatus with means to rock a chair may further comprise: a rocker foot having two bearing connector holes; a rocker bases having a motion style connector slot(s) and home connector slot(s); a bearing arm(s) having a bearing at opposite ends; a connector hardware; a movable bearing attachment; a motor mechanism having a motor with internal gear shaft; and a motor connector arm; wherein a rocker base being a hollow rectangular shape box consisting of a floor on the bottom and two end wall and two side walls having motion style connector slot(s) and home connector slot(s) at a predetermined upper portion of the side walls with an open top end; wherein a rocker foot being a solid rectangular shape having two bearing connector holes with one on the front lower portion of the rocker foot at a predetermined location and a second bearing connector holes located on the back lower portion of the rocker foot at a predetermined location using connector hardware and is located inside the said rocker base; wherein a bearing arm(s) being an elongated rectangular flat bar with an upper bearing and the lower bearing located at opposite ends of the bar with an offset and has a top and bottom and side surface and is located inside the said rocker base in between the rocker foot and the inter side walls of the rocker base; wherein the top surface side of the lower bearing of said bearing arm(s) attaches to the said rocker foot at the bearing connector hole(s) and the bottom surface side of the upper bearing is connected to the said movable bearing attachment using connector hardware; wherein the movable bearing attachment is used to connect the said bearing arm and said rocker foot to the rocker base by sliding the movable bearing attachment into the home connector slot(s) or the motion style connector slot(s); wherein said rocking apparatus has four rocking arms which all are attached in the same said manner as said rocker arm with the two lower bearings of the front bearing arms attached to front bearing connector hole(s) on opposite sides of the rocker foot and two lower bearings of the rear bearing arms attached to the rear bearing connector hole(s) on opposite sides of the rocker foot and the four movable bearing attachment are attached two to each side wall of the rocker base at the home connector slot(s) or the motion style connector slot(s); wherein the said four bearing arm being a shorter length than the rocker base sides are attached to the said rocker base at the home connector slot(s) location using connector hardware which suspend the rocker foot up off the floor and above the top of the rocker base to allows the said bearing arms to move freely with the use of the bearings on the bearing arms in a linear back and forth motion and rock a chair that sits atop of the rocker foot; wherein two identical and independent rocking apparatuses are used to make the dual rocking apparatus for mounting the chair; wherein one of the said dual rocking apparatus is on the left side of the chair under the chair arm panel and the other is on the right side of the chair under the chair arm panel lifting the chair off its foundation and allowing the chair to be rocked and controlled by the dual rocking apparatus; wherein a motor mechanism having a motor with a shaft when powered will rotate the shaft in a circular motion; wherein the motor connector arm is attached to said motor shaft at one end of the connector arm and the opposite end is attached to the rocker foot which is located inside the rocker base of the rocking apparatus; and wherein the said motor when powered will rotate the motor shaft and move the connector arm and rocker foot in a linear back and forth motion to rock a chair which sits atop of the rocker foot.

Said means of a dual rocking apparatus to replace the functions of balance and support of the base or feet of a chair may further comprise: a dual rocking apparatus; and a chair; wherein the height of said dual rocking apparatus is taller than the height of the base or feet of the chair from the floor to the bottom of the chair arm panel; wherein the dual rocking apparatus is placed one on each side of the base of the chair arm panel; wherein the chair sits atop of the rocking apparatus on the rocker foot; and wherein the dual rocking apparatus will balance and support the load of the chair to the floor thereby replacing the functions of the base or feet of the chair.

Said means of securing a chair to said dual rocking apparatuses to balance both and to allow the said dual rocking apparatus to work unison to control the said chair without using attaching hardware and accommodate various width and size chairs in a single embodiment may further comprises: a said dual rocking apparatus; a rocker foot; and a chair arm panel; wherein the base of the left chair arm panel is placed on top of the left rocker foot of the said dual rocking apparatus and the base of the right chair arm panel is placed on top of the right rocker foot of the said dual rocking apparatus which balances the chair and dual rocking apparatus from side to side and the length of the said dual rocking apparatus balances the chair from front to back securing a chair; wherein the means of said chair acts as a connecting bridge to allows the said dual rocking apparatus to work in unison and control the said chair without using attaching hardware; and wherein the said dual rocking apparatus are independent and unattached from each other and may be adjusted to a wider or narrower distance from each other to balance and accommodate various width and size chairs in a single embodiment.

Said method for mounting the universal powered rocking system which is balanced and secure for ease, quickness and convenience of transfer from one chair to another without the need for connecting hardware and aids in changing the rocking motion styles for the convenience of the user may further comprise: a said dual rocking apparatus; a said rocker base having motion style connector(s); and a movable bearing attachment; wherein the said left side of the dual rocking apparatus and the said right side of the dual rocking apparatus are identical and independent and unattached of each other; wherein the chair for mounting is sitting on the floor and is tilted backward with the back of the chair resting on the floor supported by the feet of the chair or forward with the front of the chair resting on the floor supported by the feet of the chair; wherein a left side rocking apparatus is placed on the floor parallel with the outside of the left chair foot and the end of the rocking apparatus against the base of the chair arm panel; wherein a right side rocking apparatus is placed on the floor parallel with the outside of the right chair foot and the end of the rocking apparatus against the base of the chair arm panel; wherein the chair is rolled upright to roll the base of the chair arm panel atop of the rocker foot of said dual rocking apparatus; wherein the said chair sitting atop of the rocker foot and acting as a bridge of the dual rocking apparatus balances the chair from side to side and the length of the dual rocking apparatus balances the chair from front to back lifting the chair off its foundation to control and rock the chair; wherein the reverse steps in the method will dismount the chair and the chair should be dismounted to adjust the movable bearing attachment to slide into the rocker base having motion style connector slot(s) and change the rocking motion style; and wherein the method for mounting the chair atop the rocker foot of the dual rocking apparatus balances and secure the chair for ease, quickness and convenience of transfer from one chair to another chair without the need for connecting hardware and aids in changing the rocking motion styles for the convenience of the user.

Said dual rocking apparatus with means to provide diversified rocking motion styles in a single embodiment which also eliminating the jerky movement of the linear motion may further comprise: a rocker base having a motion style connector slot(s) and home connector slot(s); a movable bearing attachment; a bearing arm(s); a upper bearing; a lower bearing; a connector hardware; a motor mechanism having a motor with an internal geared motor shaft; a motor connector arm; a rocker foot having bearing connector hole(s); and a rocking apparatus; wherein the rocking apparatus has a rocker base having a motion style connector slot(s) and home connector slot(s); wherein the rocker foot is located inside the rocker base and is attached to the rocker base using four bearing arm(s) with a upper bearing and lower bearing at opposite end of the bearing arms; wherein the lower bearing of the bearing arm is attached to the rocker foot at the bearing connector hole(s); wherein the upper bearing of the bearing arm is attached to the movable bearing attachment using connector hardware; wherein the movable bearing attachments with the connector hardware and upper bearings of said bearing arms on the left forward side of the rocker foot is removed from the home connector slots and connected to a predetermined motion style connector slot(s) by sliding the movable bearing attachment into the motion style connector slot(s) on said rocker base; wherein the movable bearing attachments with the connector hardware and upper bearings of said bearing arms on the right forward side of the rocker foot is removed from the home connector slots and connected to a predetermined motion style connector slot(s) by sliding the movable bearing attachment into the motion style connector slot(s) on said rocker base; wherein the movable bearing attachments with the connector hardware and upper bearings of said bearing arms on the left rear side of the rocker foot is removed from the home connector slots and connected to a predetermined motion style connector slot(s) by sliding the movable bearing attachment into the motion style connector slot(s) on said rocker base; wherein the movable bearing attachments with the connector hardware and upper bearings of said bearing arms on the right rear side of the rocker foot is removed from the home connector slots and connected to a predetermined motion style connector slot(s) by sliding the movable bearing attachment into the motion style connector slot(s) on said rocker base; wherein the location of the motion style connector slot(s) provides a different angle for said rocker arms which creates a different rocking motion styles when driven in a linear back and forth motion; wherein the motor connector arm is connected to the motor mechanism having a motor with an internal geared motor shaft that when powered will rotate the said motor shaft in a circular motion at one end and the rocker foot of the rocking apparatus on the opposite end in a linear back and forth motion; and wherein the motor produces a linear motion to the rocker foot and the said rocker foot has the means to convert that linear motion using the said motion style connector slot(s) into a rocking motion style that smoothes the transition of reversal motion from the linear movement and eliminate the jerky motion to which is transferred to the chair.

The universal powered rocking wherein a means of eliminating the downward load bearing weight off the motor mechanism and motor connector arm for less wear and longer life may further comprise: a said rocking apparatus; a rocker foot; a rocker base; a movable bearing attachment; a bearing arm; and a connector hardware; wherein said rocker foot is attached to said bearing arm using a connector hardware; wherein said bearing arm is attached to said rocker base using a movable bearing attachment and connector hardware; wherein the rocking apparatus has a downward load placed on the top of the rocker foot; and wherein the downward load is contained within the rocker foot, the bearing arm and the rocker base to the floor which eliminating the load bearing weight off the motor mechanism and motor connector arm for less wear and longer life.

The universal powered rocking system wherein a means of eliminating the lateral load bearing weight off the motor mechanism and motor connector arm for less wear and longer life may further comprise: a said rocking apparatus; a motor mechanism having a motor with a internal geared motor shaft; a connector hardware; a motor connector; and a said rocker foot; wherein a motor mechanism having a motor with an internal geared motor shaft is connected to the motor connector arm using connector hardware at the shaft; wherein the motor starts and stops at the position in the motion cycle where the motor has no lateral load; and wherein the running motor when turned off rotates back to the start stop position and relieves the lateral load from of the motor mechanism and motor connector arm for less wear and longer life.

The combination of a chair or object to be rocked with a universal powered rocking system wherein said universal powered rocking system may comprises: a dual rocking apparatus comprising of two identical rocking apparatus that include a rocker foot attached inside a rocker base using bearing arms and suspended above the rocker base to move freely in a linear back and forth motion when driven by a motor mechanism attached by a motor connector arm; and a means for securing said dual rocking apparatus with a chair to act as a connecting bridge to unite the said dual rocking apparatus to work in unison and act as a base or foot to the chair to balance said chair from both side to side and front to back.

DESCRIPTION OF THE DRAWINGS

The drawings described herein are for illustrative purposes only of selective embodiment and not all possible implementations, and are not intended to limit the scope of the present disclosure.

DETAILED DESCRIPTION OF THE INVENTION

Before describing the disclosed embodiment of this technology in detail, it is to be understood that the technology is not limited in its application to the details of the particular arrangement shown here, since the technology described is capable of other embodiment. Also the terminology used herein is for the purpose of description and not of limitation.

In various exemplary embodiment, the technology described herein provides a rocking apparatus, system, and associated methods and means to provide a smooth rocking reciprocatory motion to a chair or stationary object and to change to different rocking styles for the comfort of the occupant and accommodate different size and width chairs and a unique method of mounting and securing a chair for balance without the use of attachment hardware and the means to keep the original functions of the chair within a single embodiment. Examples of use is the inventive art can be an interchangeable rocking mechanism to rock objects such as chairs, cribs, bassinets, baby beds and the like and also as a permanent replacement for the base, feet or foundation of a chair or object.

Figure 3:
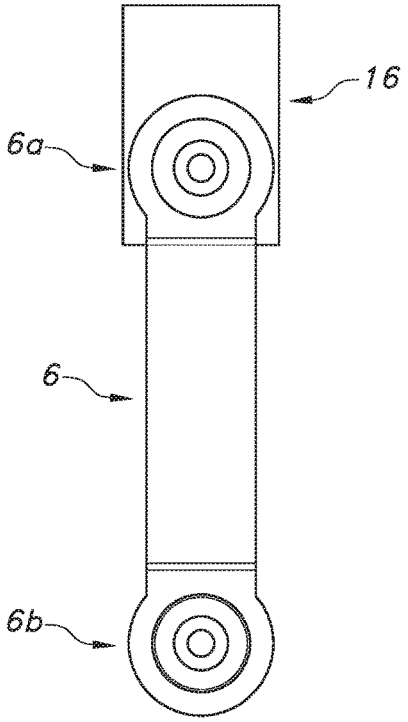
FIG. 3 is the top surface view of the bearing arm 6 having an upper bearing 6*a* at one end of the bar and a lower bearing 6*b* at the opposite ends.
Figure 4:
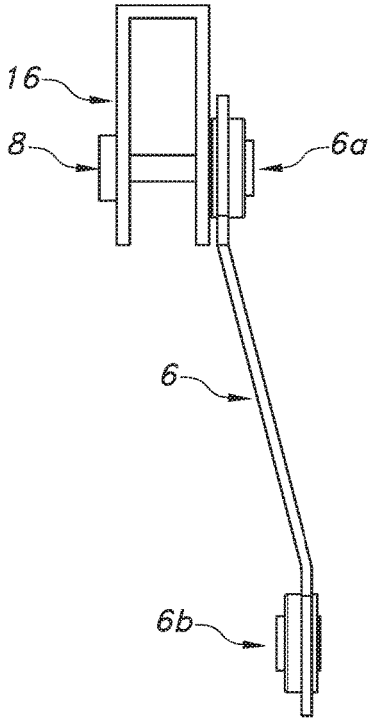
FIG. 4 is the side surface view of the bearing arm 6 revealing the two offset of the rocker arm 6 near the two bearings and the upper bearing connected to the movable bearing attachment 16 using connector hardware 8.
Figure 5:
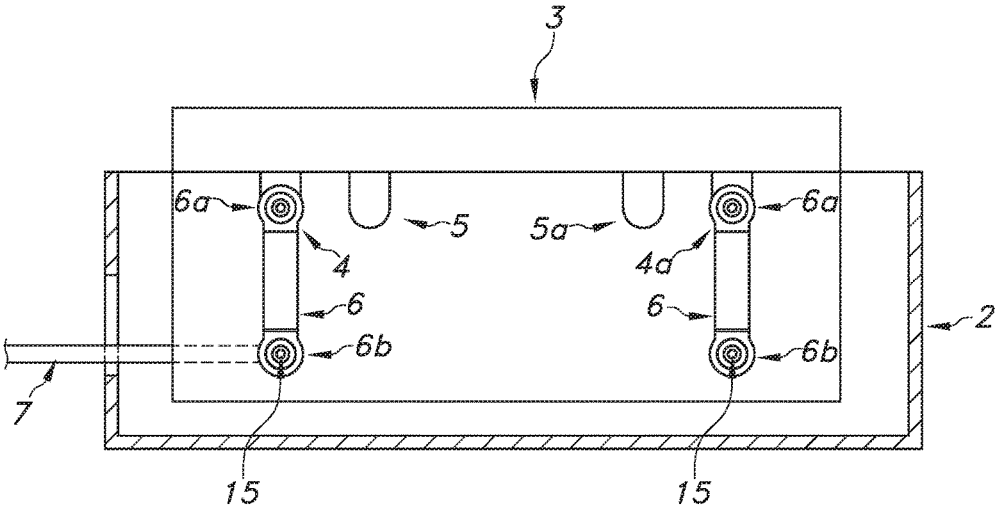
FIG. 5 is the cut away inside view of the rocking apparatus 11 without one of the rocker base 2 side wall and with the rocker foot 3 attached inside the rocker base 2 having a motion style connector slot(s) 5, 5*a* and home connector slot 4, 4*a* using the bearing arms 6. The motor connector arm 7 is connected to the rocker foot 3.

There are several means that may be used to achieve different rocking motion styles, such as a single point bearing, the rocking chair runners, and bearing arms and each is in its own separate embodiment in prior art. The preferred embodiment of this invention is disclosed using the bearing arm 6 in FIGS. 3 and 4 which is the most versatile for the user. The example of use in this patent is a dual rocking apparatus for securing a chair to the inventive art but is not limited to the number of rocking apparatuses 11 FIG. 2 or bearing arms 6 that may be used. The bearing arms 6 in FIGS. 3 and 4 are the means of motion for the inventive art to allow the user to interchange the rocking motion styles such as a swinging motion to a back and forth rocking motion, to an up and down wave motion, to a tilting back and forth glider motions in a single embodiment with the aid of a rocker base 2 FIGS. 1 and 2 having at lease one motion style connector slot(s) 5 or 5*a*. The motion style is accomplished by moving the movable bearing attachment 16 along with the upper bearing 6*a* and connector hardware 8 FIG. 2, 5, 6 of the bearing arms 6 from a home connector slot(s) 4 or 4*a* to a motion style connector slot(s) 5 or 5*a*, located on the rocker base 2 FIG. 5. This mean changes the angle and position of the bearing arm 6 FIG. 5 with respect to the original home connector 4, 4*a* position of the rocker foot 3 and the rocker base 2 producing a different rocking motion styles as the rocker foot 3 is moved linearly back and forth by the motor connector arm 7. This described embodiment will be refer to hence forth in this patent.

Figure 1:
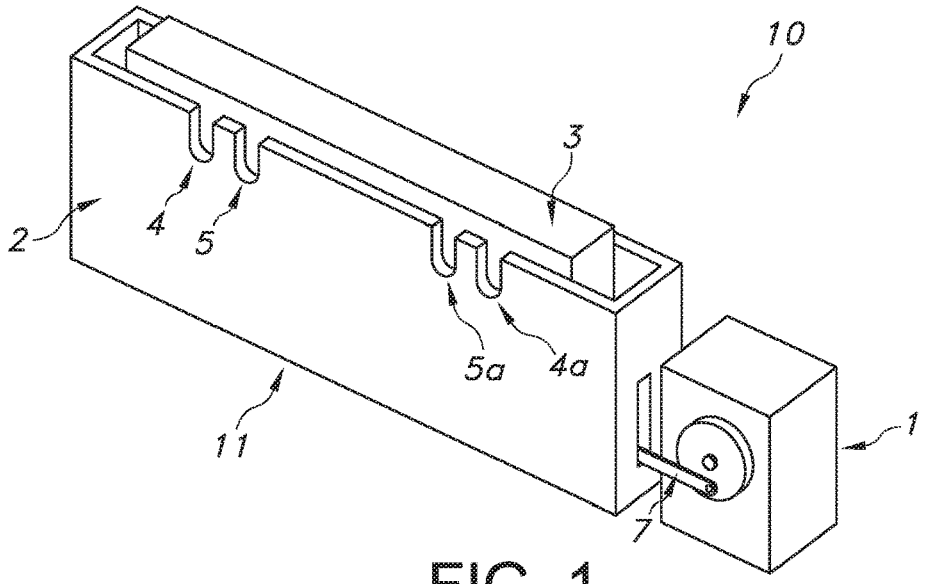
FIG. 1 is the left rear top side perspective view of the universal powered rocking system 10 illustrated with a motor mechanism 01 at the rear of the rocking apparatus 11 with the rocker foot 03 located inside the rocker base 2 having a motion style connector slot(s) 5, 5*a* and home connector slot(s) 4, 4*a* and the motor connector arm 7 protruding from the rocker base 2 and connected to the motor mechanism 01 on one end.
Figure 2:
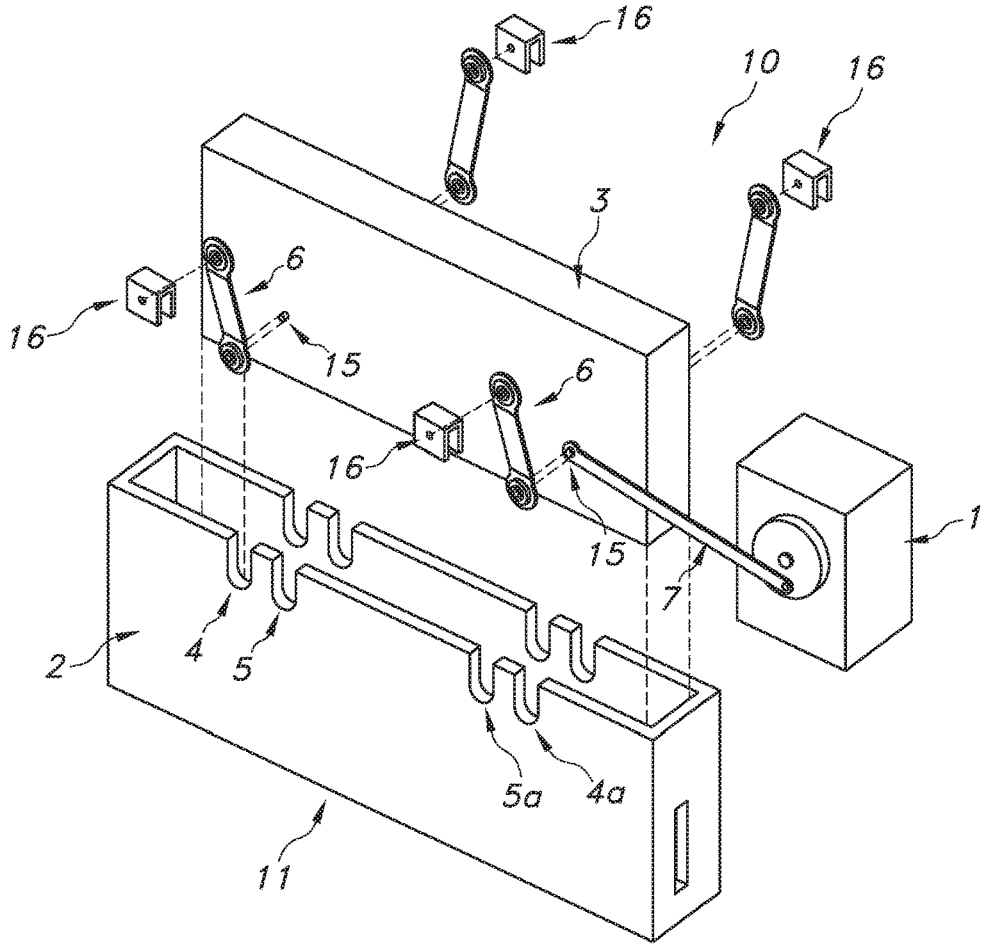
FIG. 2 is the exploded view of the universal powered rocking system of FIG. 1 showing the motor connector arm 7 connected to the motor mechanism 01 on one end and the rocker foot 3 at the opposite end and the location of the bearing arm(s) 6 with the lower bearing 6*b* connected to the rocker foot 3 at the bearing connector holes 15 and the upper bearing 6*a* attached to the movable bearing attachment 16 which slide into the appropriate home connector slots 4, 4*a* or motion style connector slot(s) 5, 5*a* in the rocker base 2 with connector hardware 8.

Referring now to the FIGS. 1 and 2 the inventive art 10 is disclosed. The inventive art 10 comprises of a rocking apparatus 11 and a motor mechanism 1 connected together using the motor connector arm 7.

The rocking apparatus 11 FIGS. 1 and 2 has a rocker foot 3 and four bearing arms 6 located inside a rocker base 2. The four bearing arms 6 which are two on the left side and two bearing arm 6 on the right side of the rocker foot 3 attaches the rocker foot 3 to the rocker base 2 and acts to balances the load put on top of the rocker foot 3. The height of the rocker base 2 and the rocker foot 3 is greater than the height of the chair base or feet 12 FIGS. 7 and 8 from the floor to the base of the chair arm panel 9.

Figure 6:
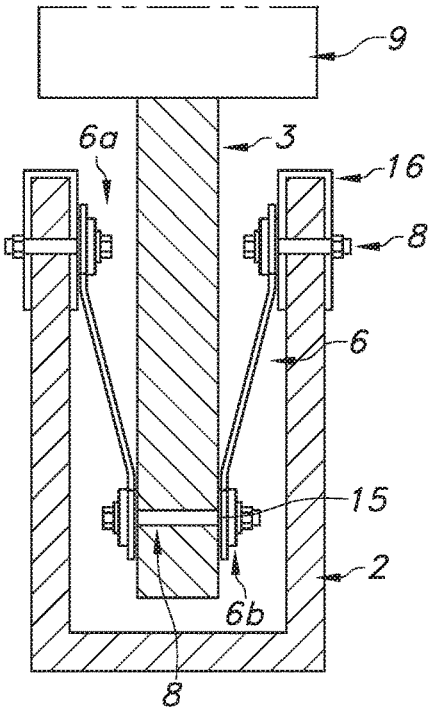
FIG. 6 is the end view of the rocking apparatus illustrating the connection of the internal parts revealing the rocker foot 3 connected inside the rocker base 2 using the upper bearing 6*a* of the bearing arm 6 which is attached to the movable bearing attachment 16 with connector hardware 8 to slide into and lock into the home connector slot 4, 4*a* and the lower bearing 6*b* attached to the rocker foot 3 at the bearing connector hole 15 with the offset of the bearing arms 6 allowing the rocker foot 3 to move freely.

The rocker base 2 FIGS. 1, 2, and 6 is a hollow rectangular shape box consisting of a floor on the bottom and two end wall and two side walls having at lease one motion style connector slot(s) 5, 5*a* and home connector slot(s) 4, 4*a* at a predetermined upper portion of the side walls with an open top end. The rocker base 2 supports the downward load of the chair to the floor.

The rocker foot 3 FIG. 2 is a rectangular solid structure having two bearing connector holes 15 at the lower front and back portion of the rocker foot 3. The top surface of the rocker foot 3 is use to contain the chair arm panel 9 FIG. 7 which sits atop to be rocked. The rocker foot 3 also supports the downward load of the chair.

The bearing arm(s) 6 referred to in FIGS. 3 and 4 being an elongated rectangular flat bar with a top and bottom and side surfaces and a upper bearing 6*a* and a lower bearing 6*b* at the opposite ends of the bar. FIG. 2 There are four bearing arm 6 for each rocking apparatus 11 with two on the left side and two on the right side of the rocker foot 3. The top surface side of the lower bearings 6*b* of the bearing arms 6 are attached to the rocker foot 3 at the bearing connector holes 15 using connector hardware 8. The bottom surface side of the upper bearings 6*a* of the bearing arms 6 are attached to the movable bearing attachments 16 using connector hardware 8. The movable bearing attachments 16 are slid into the appropriate home connector slot(s) 4, 4*a* or motion style connector slot(s) 5, 5*a* on the top of the side walls of the rocker base 2 allowing a means to change to different rocking motion styles. The rocking motion style is based on the circular motion of the bearing arm 6 around the upper bearing 6*a* of the bearing arm 6 which is in a stationary position in one of the motion style connector slot(s) 5, 5*a*. The angle of the bearing arms 6 at the rest position when the motor is off is the starting position and will start the rocker foot 3 motion to move forward downward until reaching the bottom of the arc or forward upward until reaching the end of the linear motion cycle based on the location of the movable bearing attachment 16 in the motion style connector slot(s) 5, 5*a* on the rocker base 2. Then on reverse or backward motion the rocker foot will move in the opposite movement. This linear movement back and forth creates the rocker motion style and can be changed by adjusting the movable bearing attachments 16 to a different motion style connector slot(s) 5, 5*a*. The offset of the bearing arms 6 FIG. 6 when attached between the rocker foot 3 and the rocker base 2 will support the downward load of the chair arm panel 9 and suspend the rocker foot 3 above the floor and the top of the rocker base 2 allowing the rocker foot 3 to move freely and swing in a linear motion back and forth between the rocker base 2 side walls.

The motor mechanism 1 FIGS. 1 and 2 having a motor in a housing with an internal gear shaft that rotates when powered. The motor mechanism 1 has the means to provide a reciprocatory linear back and forth motion for the rocking apparatus 11 via the rocking foot 3.

The motor connector arm 7 FIG. 2 is attached to the motor mechanism 1 at the rotating motor shaft at one end and the rocker foot 3 at the opposite end to drive the rocker foot 3 in a reciprocatory linear back and forth motion and the rocker foot 3 transfers that rocking motion style to the chair arm panel 9 and chair which sits atop of the rocker foot 3.

Figure 7:
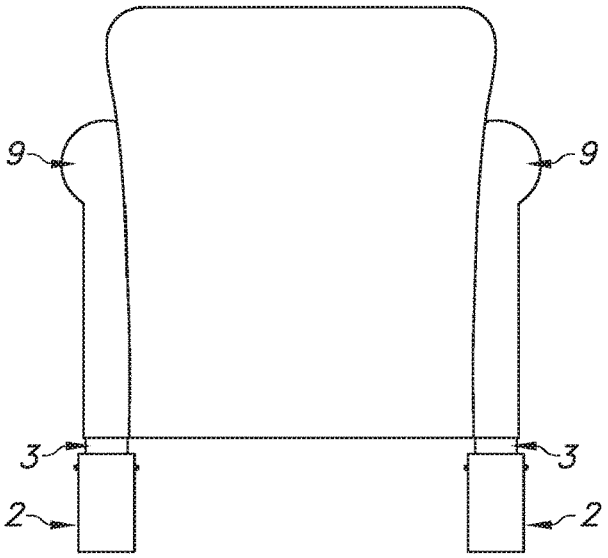
FIG. 7 is the back view of the chair showing the mounting of the universal powered rocking system with the chair using a dual rocking apparatus having a rocker base 2 on each side of the chair and the chair arm panel 9 sitting atop of the rocker foot 3.

The inventive art uses a dual rocking apparatus 11 for mounting a chair. FIG. 7 The dual rocking apparatus 11 are two independent unconnected and identical rocking apparatuses 11 and are placed under both sides of the base of the chair arm panel 9 to act as a bridge to balance the chair from side to side from over turn and the length of the rocking apparatus 11 balances the chair forward and backward from over turn without the use of attaching hardware.

In FIGS. 6 and 7 the rocker foot 3 extends above the top of the rocker base 2 which the chair arm panel 9 sits atop. The rocker base 2 with the attached rocker foot 3 height has a greater distance than the foot of the chair on the floor to the bottom of the chair arm panel 9 which raises the chair off its foundation when sitting atop the rocker foot 3 replacing the base or chair foot allowing the chair to move freely and be controlled by the inventive art without the need for attaching hardware.

The motor mechanism 1 FIG. 2 may be attached to either one of the dual rocking apparatus 11. The chair is balanced on the rocker foot 3 and the downward load of the chair is placed on the rocker foot 3, the bearing arm 6 and rocker base 2 and not on the motor mechanism 1 and connector arm 7. The motor connector arm 7 rotates back to the original start stop position when turned off which relieves any lateral load transferred to the motor mechanism 1 and motor connector arm 7. The original start stop position of the motor connector arm 7 is where the bearing arm 6 stops at the no load rest position at the bottom of the rotational cycle of the motor mechanism 1. This mean of the inventive art improves the life of the motor mechanism 1 and cuts cost which makes the invention more marketable.

The dual rocking apparatus 11 are identical and independent and due to the chair sitting atop of the rocker foot 3, the chair acts as a bridge to connect the dual rocking apparatus 11 and makes them work in unison with each other which allows the use of only one motor mechanism 1 to operate the inventive art and allows the rocking apparatus 11 to easily be mounted between the bottom of the arm panel 9 and the floor without the need for attaching hardware to connect the chair arm panel 9 resulting in a balanced and secure chair when placed atop of the rocker foot 3. The dual rocking apparatus 11 has the means of rock stationary style chair, able to accommodate different widths and size chairs and being universal makes it easier to install and transfer to other chairs and allows switching to different styles of rocking motion within the same embodiment which makes the invention user friendly and more marketable.

Figure 8:
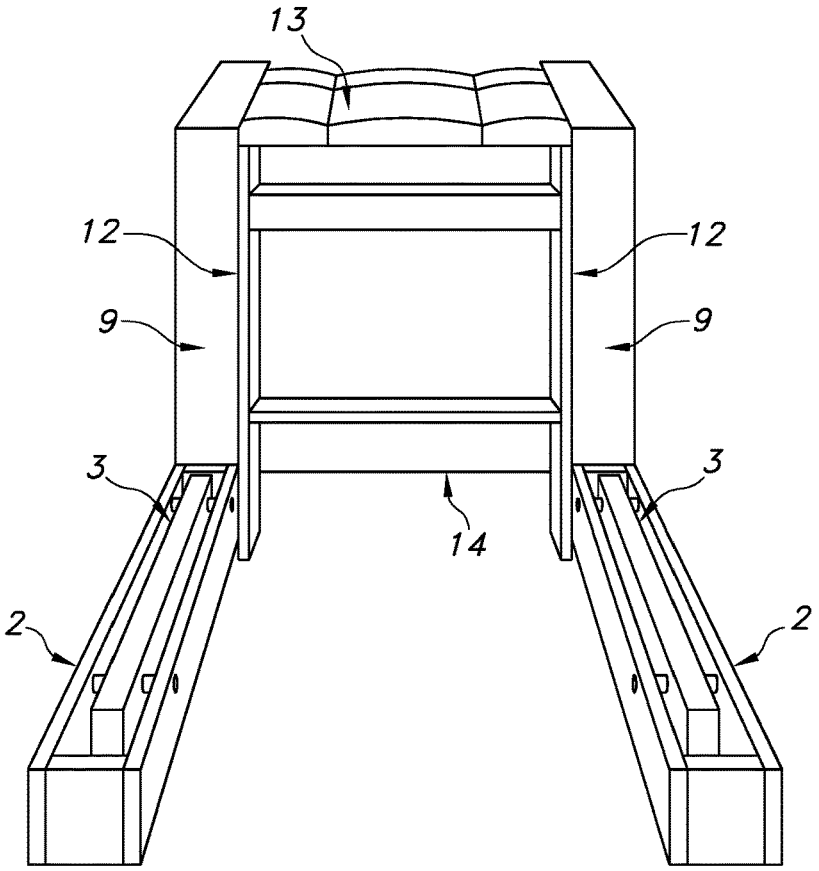
FIG. 8 is the bottom view of the chair and the front view of the dual rocking apparatus exposing the mounting method of rolling the chair off its feet to mount the dual rocking apparatus.
Figure 9:
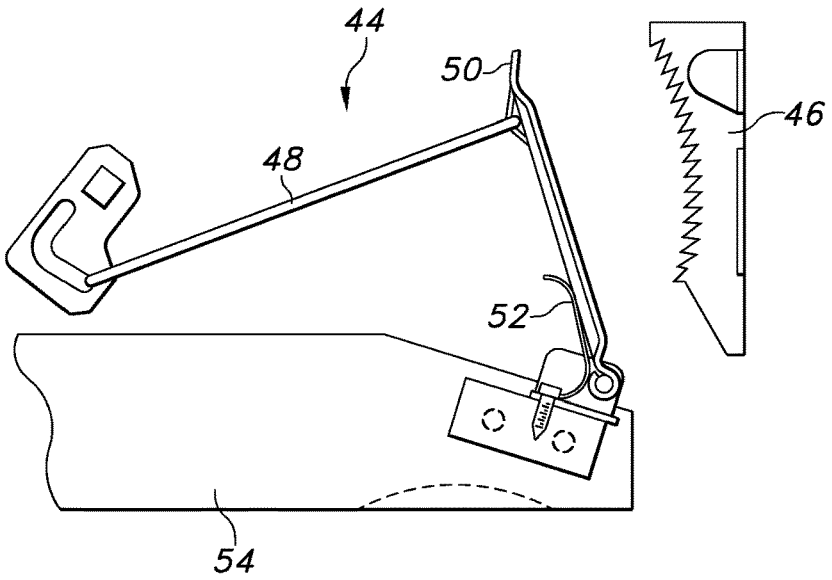
FIG. 9 (PRIOR ART)
FIG. 9 is the right side view of the pawl and ratchet latching mechanism which is incorporated in the frame of the chair and the property of the manufacturer of the reclining rocking char, illustrating the pawl and ratchet latching mechanism mounted to the frame of the base of the chair and the ratchet hardware mounted to the frame of the seat of the chair. The view exposes the ratchet hardware mounted on the frame of the rocking chair closest to the leg rest and the pawl in not latched to the ratchet hardware.

Referring to FIG. 8 reveals the unique method of mounting the chair to the universal powered rocking system 10 FIG. 1 which uses dual rocking apparatus 11. A simple one man operation method used to mount and dismount the chair to accommodating changing to different chairs and switching rocker motion styles for the user begins with the feet of the chair 12 FIG. 8 resting on the floor and the chair is tilted backward to rest the chair back 14 on the floor supported by the feet of the chair 12. or the chair may also be tilted forward to rest the chair front 13 on the floor supported by the feet of the chair 12. The right side rocking apparatus 11 is placed on the floor on the right side of the chair with the end against the base of the chair arm panel 9 and the length of the rocking apparatus 11 lying on the floor and parallel with the outside of the feet of the chair 12. The left side rocking apparatus 11 is placed on the floor on the left side of the chair with the end against the base of the chair arm panel 9 and the length of the rocking apparatus 11 lying on the floor and parallel with the outside of the feet of the chair 12. Once in position the chair is rolled upright and the chair arm panel 9 will roll upon and sit atop of the rocker foot 3 in the rocking apparatus 11 to move freely. The chair will be balanced and maintained securely atop of the rocker foot 3. Reverse the operation to remove the chair from the rocking apparatus 11.

The rocker foot 3 is attached to the powered motor mechanism 1 with the motor connector arm 7 with the means to move the chair in a reciprocatory linear back and forth motion. The rocking motion styles of the rocker foot 3 are selected by moving the movable bearing attachment 16 and connector hardware 8 with the upper bearing **6*a* of the bearing arm 6 to a motion style connector slot(s) 5 and 5*a* at a specified location. The rocking styles eliminates the inherent jerky motion of a regular straight line reciprocatory linear motion by breaking up the sudden reverse in motion of the motor connector arm 7**.

The inventive art is a system with dual rocking apparatus 11 that has the means to rock stationary style chairs with and without the ability to manually rock and without compromising the use of the original functions of the chair. The inventive art has the means to balance a chair without the use of attaching hardware to the chair. The inventive art using dual rocking apparatus 11 has the means to rock a chair in a variety of different and interchangeable motion styles in a single embodiment and using these motion styles to provide a smother linear motion. The inventive art dual rocking apparatus 11 has the means to adjust to different size and width chairs in a single embodiment. The inventive art dual rocking apparatus 11 has a new method of mounting to a chair without the use of attaching hardware and can be mounted by a single person for ease of interchanging with different chairs. And the invention dual rocking apparatus 11 has a means of eliminates the load bearing weight off the motor mechanism and motor connector arm for longer life.

What is claimed is:

1. A universal powered rocking system comprising:

two rocker bases each comprising an elongate box with elongate sidewalls, an open top, and opposite longitudinal ends, wherein the elongate sidewalls of each of the two rocker bases comprise a plurality of mounting structures at predetermined positions in upper portions of one or more of the elongate sidewalls;

two rocker feet each comprising an elongate member disposed in a respective one of the elongate boxes for rocking motion of the rocker feet in the elongate boxes;

at least two bearing arms glidingly supporting each of the two rocker feet in the respective elongate boxes, wherein the bearing arms are pivotally connected to the upper portions of the elongate sidewalls at respective ones of the plurality of mounting structures and the bearing arms are pivotally connected to lower portions of the elongate members of the rocker feet;

wherein each of the rocker bases comprises a floor defining a bottom surface adapted for resting on a floor to support the universal powered rocking system on the floor;

wherein each of the two rocker feet comprises upper surfaces with portions adapted to support a wide variety of feet, legs, or bases of a wide variety of chairs or other objects in order to provide stable rocking support to the chairs or other objects; and wherein the plurality of mounting structures comprises a number of mounting structures greater than a number of the bearing arms for each of the rocker bases such that the bearing arms may be selectively mounted to the rocker bases in different configurations to selectively determine a desired rocking motion style.

2. The universal powered rocking system of claim 1, further comprising:

a motor mechanism separate from the rocker bases and the rocker feet and adapted to be supported separately from the rocker bases and the rocker feet during use;

wherein one of the longitudinal ends of one of the elongate boxes comprises a motor connector opening; and wherein the motor mechanism is drivingly coupled to one or more of the rocker feet by a motor connector arm extending through the motor connector opening.

3. The universal powered rocking system of claim 2, comprising:

means for securing a chair to said universal powered rocking system to control said chair without using attaching hardware and accommodate various widths and sizes of chairs;

means for mounting the said powered rocking system which is balanced and secure for ease, quickness and convenience of transfer from one chair to another chair; and means for eliminating jerky movement of the substantially linear motion.

4. The universal powered rocking system of claim 2, wherein:

each rocker foot comprises two bearing connector holes;

the plurality of mounting structures of each rocker base comprise at least two motion style connector slots and at least two home connector slots, and at least two movable bearing attachments;

each of the bearing arms comprises a bearing at opposite bearing arm ends and associated connector hardware.

5. The universal powered rocking system of claim 2, wherein:

each of the rocker bases is a hollow rectangular shaped box consisting of the floor on the bottom, the two elongate sidewalls having the mounting structures comprising motion style connector slots and home connector slots at the predetermined positions in the upper portion of the sidewalls, and end walls defining an open top;

each of the rocker feet is a solid rectangular member having two bearing connector holes with a first bearing connector hole located on a front lower portion of the rocker foot at a predetermined location and a second bearing connector hole located on a rear lower portion of the rocker foot at a predetermined location using connector hardware and located inside the said rocker base.

6. A chair combined with the universal powered rocking system of claim 5, wherein:

one of the rocker bases, one of the rocker feet and two or more of the bearing arms that interconnect the one of the rocker bases and the one of the rocker feet make up a rocking apparatus;

two identical and independent ones of the rocking apparatuses are used to make up a dual rocking apparatus for supporting a chair mounted thereon;

wherein one of the said rocking apparatuses is on a left side of the chair under a left chair arm panel or left chair base foot and the other of the rocking apparatuses is on a right side of the chair under a right chair arm panel or right chair base foot, thus lifting the chair off its floor foundation and allowing the chair to be rocked and controlled by the dual rocking apparatus.

7. A chair combined with the universal powered rocking system of claim 1, wherein:

a dual rocking apparatus comprises two identical rocking apparatuses that each includes one of the rocker feet attached inside one of the rocker bases by at least two of the bearing arms and the rocker feet each suspended with an upper surface of each rocker foot above the rocker base to move freely in a linear back and forth motion; and a chair secured to said dual rocking apparatus, wherein the chair acts as a connecting bridge to unite the two rocking apparatuses to work in unison and to act as a base or foot to the chair to balance said chair from both side to side and front to back.

8. The combination of claim 7, further comprising a motor mechanism attached to the dual rocking apparatus by a motor connector arm.

* * * * *